US006596392B1

(12) United States Patent
Tanaka et al.

(10) Patent No.: US 6,596,392 B1
(45) Date of Patent: Jul. 22, 2003

(54) SHEATHED WIRES AND CABLES

(75) Inventors: Mutsuhiro Tanaka, Ichihara (JP); Shinichi Nagano, Ichihara (JP); Tomohiko Kimura, Ichihara (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 09/646,613

(22) PCT Filed: Jan. 29, 1999

(86) PCT No.: PCT/JP99/00389

§ 371 (c)(1),
(2), (4) Date: Sep. 20, 2000

(51) Int. Cl.[7] ..... D02G 3/00; H01B 7/00

(52) U.S. Cl. ..... 428/379; 428/375; 428/383; 428/372; 174/110 PM; 174/110 SR; 174/120 SR; 525/191; 525/240

(58) Field of Search ..... 428/375, 379, 428/383, 372; 174/110 PM, 110 SR, 120 SR; 525/191, 240

(56) References Cited

U.S. PATENT DOCUMENTS

| | | | | | |
|---|---|---|---|---|---|
| 5,556,697 | A | * | 9/1996 | Flenniken | 428/323 |
| 5,707,732 | A | * | 1/1998 | Sonoda et al. | 428/357 |
| 6,180,721 | B1 | * | 1/2001 | Rogestedt et al. | 525/191 |
| 6,255,399 | B1 | * | 7/2001 | Castellani et al. | 525/232 |
| 6,329,054 | B1 | * | 12/2001 | Rogestedt et al. | 428/378 |
| 6,329,465 | B1 | * | 12/2001 | Takahashi et al. | 525/191 |

FOREIGN PATENT DOCUMENTS

| | | | |
|---|---|---|---|
| JP | A6009724 | | 1/1994 |
| JP | A6136195 | | 5/1994 |
| JP | A6136196 | | 5/1994 |
| JP | A6207057 | | 7/1994 |
| JP | 8-269270 | A * | 10/1996 |
| JP | 9-12792 | * | 1/1997 |
| JP | A9231839 | | 9/1997 |
| JP | A10114808 | | 5/1998 |
| JP | A10168248 | | 6/1998 |
| JP | 11-283444 | * | 10/1999 |
| JP | 11-293054 | * | 10/1999 |
| JP | 11-293055 | * | 10/1999 |

* cited by examiner

*Primary Examiner*—J. M. Gray
(74) *Attorney, Agent, or Firm*—Birch, Stewart, Kolasch & Birch, LLP

(57) ABSTRACT

The sheathed wire or cable of the invention is obtained by coating an outermost layer of a wire or cable with a polyethylene resin produced by polymerization using a single-site catalyst. The polyethylene resin preferably has the properties: (i) the 50% crack occurrence time ($F_{50}$), that becomes an indication of stress crack resistance, is not less than 600 hours, (ii) the abrasion wear as measured by a Taber abrasion test is not more than 10 mg, and (iii) the Izod impact strength (notched) as measured at −40° C. is not less than 40 J/m$^2$. In the polyethylene resin, high-pressure low-density polyethylene may be contained. The sheathed wire and cable exhibit excellent stress crack resistance, abrasion resistance and low-temperature impact resistance because their sheaths have stress crack resistance, abrasion resistance and low-temperature impact resistance better than those of conventional polyethylene sheaths.

10 Claims, No Drawings

SHEATHED WIRES AND CABLES

TECHNICAL FIELD

The present invention relates to sheathed wires and cables, and more particularly to wires and cables with polyethylene resin sheaths having excellent stress crack resistance, abrasion resistance and impact resistance.

BACKGROUND ART

As materials of sheaths for protecting wires (wire sheaths as the outermost layers) and those for protecting power or telegraph cables, synthetic resins such as polyethylene and polyvinyl chloride have heretofore been employed.

Such sheaths need to be excellent in properties such as stress crack resistance (ESCR), abrasion resistance and impact resistance, particularly low-temperature impact resistance, differently from coatings for directly insulating individual wires or cables. As their uses are diversified and the use conditions become severer recently, development of sheathed wires and cables having better properties than before have been more desired.

It is an object of the present invention to provide wires and cables with polyethylene resin sheaths more improved in stress crack resistance, abrasion resistance and impact resistance than the conventional polyethylene sheaths.

DISCLOSURE OF THE INVENTION

The sheathed wire or cable is obtained by coating an outermost layer of a wire or cable with a polyethylene resin (A) produced by polymerization using a single-site catalyst.

In the present-invention, the polyethylene resin (A) is preferably a copolymer of ethylene and an α-olefin of 3 to 20 carbon atoms and has the following properties:

(1) the density (d) is in the range of 0.880 to 0.950 g/cm$^3$, and (2) the melt flow rate (MFR, ASTM D 1238, 190° C., load: 2.16 kg) is in the range of 0.01 to 20 g/10 min.

The polyethylene resin (A) preferably further has the following properties:

the n-decane-soluble component fraction (W (% by weight)) at room temperature and the density (d (g/cm$^3$)) satisfy the following relation in case of MFR≦10 g/10 min:

$$W<80\times\exp(-100(d-0.88))+0.1,$$

in case of MFR>10 g/10 min:

$$W<80\times(MFR-9)^{0.35}\times\exp(-100(d-0.88))+0.1.$$

The polyethylene resin (A) preferably furthermore has the following properties:

the flow index (FI (1/sec)), which is defined as a shear rate at which the shear stress of the polymer in a molten state at 190° C. reaches $2.4\times10^6$ dyne/cm$^2$, and the melt flow rate (MFR (g/10 min)) satisfy the following relation

FI>75×MFR.

Moreover, it is preferable that when the polyethylene resin (A) is subjected to a temperature rise elution test (TREF), a component that is eluted at a temperature of not lower than 100° C. is present in the resin, and the amount of the component is not more than 10% by weight of the whole elution amount.

In the polyethylene resin (A), high-pressure low-density polyethylene (B) may be contained in an amount of not more than 50% by weight.

In the present invention, the polyethylene resin (A) preferably has the following properties:

(i) the 50% crack occurrence time ($F_{50}$, ASTM D 1698) that becomes an indication of stress crack resistance is not less than 600 hours, (ii) the abrasion wear as measured by a Taber abrasion test (JIS K 7204, load: 1 kg, truck wheel: CS-17, 60 rpm, 1000 times) is not more than 10 mg, and (iii) the Izod impact strength (ASTM D 256, notched) as measured at −40° C. is not less than 40 J/m$^2$.

BEST MODE FOR CARRYING OUT THE INVENTION

The sheathed wire and cable according to the invention are described in detail hereinafter.

The polyethylene resin for forming sheaths of the sheathed wire and cable according to the invention is a polyethylene resin (A) having specific properties and is prepared by the use of a single-site catalyst such as a hitherto known metallocene catalyst or Brookhart catalyst. In the polyethylene resin (A), high-pressure low-density polyethylene (B) may be contained.

Polyethylene Resin (A)

The polyethylene resin (A) for use in the invention has a density (ASTM D 1505) of usually 0.880 to 0.950 g/cm$^3$, preferably 0.885 to 0.940 g/cm$^3$, more preferably 0.890 to 0.935 g/cm$^3$. When the polyethylene resin (A) having a density in the above range is used, a wire sheath and a cable sheath having excellent abrasion resistance and flexibility can be formed.

The density is determined as follows. Strands obtained in the measurement of melt flow rate (MFR) at 190° C. under a load of 2.16 kg is heat treated at 120° C. for 1 hour and slowly cooled to room temperature over a period of 1 hour. Then, the density is measured by a density gradient tube.

The polyethylene resin (A) has a melt flow rate (MFR, ASTM D 1238, 190° C., load: 2.16 kg) of usually 0.01 to 20 g/10 min, preferably 0.03 to 15 g/10 min, more preferably 0.05 to 10 g/10 min.

The n-decane-soluble component fraction (W (% by weight)) in the polyethylene resin (A) for use in the invention at room temperature and the density (d (g/cm$^3$)) of the resin satisfy the following relation in case of MFR <10 g/10 min:

$$W<80\times\exp(-100(d-0.88))+0.1,$$

preferably $W<60\times\exp(-100(d-0.88))+0.1$, more preferably $W<40\times\exp(-100(d-0.88))+0.1$, in case of MFR>10 g/10 min:

$$W<80\times(\mathrm{MFR}-9)^{0.35}\times\exp(-100(d-0.88))+0.1.$$

It can be said that such an ethylene copolymer has a narrow composition distribution.

The n-decane-soluble component fraction (W) in the polyethylene resin (A) at room temperature is desired to be not more than 3% by weight, preferably not more than 2% by weight. When the n-decane-soluble component fraction (W) is not more than 3% by weight, a sheath that is free from surface tackiness when exposed to high temperatures can be obtained.

The n-decane-soluble component fraction (W) at room temperature is determined by completely dissolving 0.5 g of a polyethylene resin in 500 ml of n-decane under reflux at a boiling point of n-decane, then cooling the resulting solution to room temperature (25° C.), filtering the solution, evaporating n-decane from the filtrate, and calculating a weight ratio of the residue to the initial polyethylene resin.

The flow index (FI (1/sec)) of the polyethylene resin (A) for use in the invention, which is defined as a shear rate at which the stress of the polymer in a molten state at 190° C. reaches $2.4\times10^6$ dyne/cm$^2$, and the melt flow rate (MFR (g/10 min)) of the resin satisfy the following relation

FI>75×MFR, preferably FI>80×MFR, more preferably FI>85×MFR.

The flow index (FI) is determined by extruding a resin from a capillary with changing a shear rate and measuring a shear rate corresponding to the given stress. That is, this measurement was carried out using the same sample as in the MT measurement and using a capillary type flow property tester manufactured by Toyo Seiki Seisakusho K. K. under the conditions of a resin temperature of 190° C. and a shear stress range of about $5\times10^4$ to $3\times10^6$ dyne/cm$^2$. In this measurement, the diameter of a nozzle is changed as follows according to the MFR (g/10 min) of the resin to be measured.

MFR>20: 0.5 mm

20≧MFR>3: 1.0 mm

3≧MFR>0.8: 2.0 mm 0.8≧MFR: 3.0 mm

When a polyethylene resin having a narrow composition distribution is prepared by the prior art technique, also the molecular weight distribution is usually narrowed, resulting in bad flowability (moldability) and small FI. When the polyethylene resin (A) for use in the invention has the above relation between. FI and MFR, a low stress can be retained even in the high shear rate region and the moldability becomes better.

When the polyethylene resin (A) for use in the invention is subjected to a temperature rise elution test (TREF), a component that is eluted at a temperature of not lower than 100° C. is desired to be present and the amount of the component is preferably not more than 10% of the whole elution amount. The component that is eluted at a temperature of not lower than 100° C. is a highly crystalline high-density component. If the amount of this high-density component increases, the heat resistance is improved, but if the amount thereof exceeds 10% by weight, the flexibility of the polymer is lowered, and such a polymer is unfavorable as a material of sheath.

The temperature rise elution test (TREF) is carried out in the following manner.

A sample solution is placed in a column at 140° C., then cooled to 25° C. at a cooling rate of 10° C./hr and heated at a heating rate of 15° C./hr to detect, on the online system, components having been continuously eluted at a constant flow rate of 1.0 ml. This test was carried out using a column of 2.14 cm (diameter)×15 cm, glass beads having a diameter of 100 $\mu$m as packing and orthodichlorobenzene as a solvent under the conditions of a sample concentration of 200 mg/40 ml-orthodichlorobenzene and a pour of 7.5 ml.

The polyethylene resin (A) can be prepared by polymerizing ethylene only or copolymerizing ethylene and an α-olefin of 3 to 20 carbon atoms in the presence of a single-site catalyst, e.g., a so-called metallocene type olefin polymerization catalyst containing a metallocene catalyst component described in Japanese Patent Laid-Open Publications No. 9724/1994, No. 136195/1994, No. 136196/1994, No. 207057/1994, etc.

That is, the polyethylene resin (A) for use in the invention is an ethylene homopolymer or an ethylene/α-olefin copolymer prepared by the use of a single-site catalyst such as a metallocene type olefin polymerization catalyst.

Examples of the α-olefins of 3 to 20 carbon atoms employable in the copolymerization with ethylene include propylene, 1-butene, 1-pentene, 1-hexene, 4-methyl-1-pentene, 1-octene, 1-decene and 1-dodecene. Of these, preferable are α-olefins of 3 to 10 carbon atoms, and particularly preferable are α-olefins of 4 to 8 carbon atoms.

These α-olefins can be used singly or in combination of two or more kinds.

In the polyethylene resin (A), constituent units derived from ethylene are desirably present in amounts of not less than 75% by weight and less than 100% by weight, preferably 80 to 99% by weight, more preferably 80 to 97% by weight, and constituent units derived from an α-olefin of 3 to 20 carbon atoms are desirably present in amounts of not more than 25% by weight, preferably 1 to 20% by weight, more preferably 3 to 20% by weight.

In the present invention, the polyethylene resin (A) can be used singly as a polyethylene resin for sheath, or it may be used as its blend with high-pressure low-density polyethylene (B). When the polyethylene resin (A) is used as its blend with the high-pressure low-density polyethylene (B), the high-pressure high-density polyethylene (B) is used in an amount of not more than 100 parts by weight, preferably not more than 70 parts by weight, more preferably not more than 50 parts by weight, based on 100 parts by weight of the polyethylene resin (A). When the polyethylene resin (A) is used in this proportion, a sheath having excellent stress crack resistance, abrasion resistance and low-temperature impact resistance can be formed.

In the present invention, the polyethylene resin (A) can be used singly or after blended with a resin having different melt flow rate and density.

As the polyethylene resin (A), particularly preferable is such a polyethylene resin as to form a sheath having the following properties:

(i) the 50% crack occurrence time ($F_{50}$, ASTM D 1698) that becomes an indication of stress crack resistance of the sheath is preferably not less than 600 hours, more preferably not less than 1000 hours, (ii) the abrasion wear as measured by a Taber abrasion test (JIS K 7204, load: 1 kg, truck wheel: CS-17, 60 rpm, 1000 times) is preferably not more than 10 mg, more preferably not more than 8 mg, and (iii) the Izod impact strength (ASTM D 256, notched) as measured at −40° C. is preferably not less than 40 J/m$^2$, more preferably not less than 50 g/m$^2$.

High-pressure Low-density Polyethylene (B)

The high-pressure low-density polyethylene (B) that is optionally used in the invention is polyethylene prepared by polymerizing ethylene under high pressure in the presence of a radical polymerization catalyst, and may be one obtained by copolymerizing ethylene and a small amount of a vinyl monomer if necessary.

The high-pressure low-density polyethylene (B) has a density (ASTM D 1505) of usually not more than 0.930 g/cm$^3$, preferably 0.910 to 0.925 g/cm$^3$. When the high-pressure low-density polyethylene (B) having a density in the above range is used, a polyethylene resin capable of forming a sheath of excellent abrasion resistance and flexibility can be obtained. The density can be measured in the same manner as described above.

The high-pressure low-density polyethylene (B) has a melt flow rate (MFR, ASTM D 1238, 190° C., load: 2.16 kg) of usually 0.05 to 20 g/10 min, preferably 0.1 to 10 g/10 min. When the high-pressure low-density polyethylene (B) having a melt flow rate in the above range is used, extrusion coating processability can be enhanced.

Other Components

In the polyethylene resin for sheath employable in the invention, hitherto known additives, such as heat stabilizer, weathering stabilizer, carbon black, pigment, flame retardant and anti-aging agent, may be contained in amounts not detrimental to the object of the invention, in addition to the polyethylene resin (A) or the polyethylene resin (A) and the high-pressure low-density polyethylene (B).

The wire and cable with sheaths having the above properties can be formed by a conventional extrusion coating method using the polyethylene resin (A) or its blend with the high-pressure low-density polyethylene (B).

EFFECT OF THE INVENTION

The sheathed wire and cable according to the invention exhibit excellent stress crack resistance, abrasion resistance and low-temperature impact resistance because their sheaths have stress crack resistance, abrasion resistance and low-temperature impact resistance better than those of conventional polyethylene sheaths.

EXAMPLE

The present invention is further described with reference to the following examples, but it should be construed that the invention is in no way limited to those examples.

The sheets obtained in the examples and the comparative examples underwent tests of stress crack resistance, abrasion resistance and low-temperature impact resistance by the following methods.

Test Method (1) Stress Crack Resistance (ESCR)

A stress crack test was carried out in accordance with ASTM D 1698 to measure a 50% crack occurrence time ($F_{50}$), and said 50% crack occurrence time ($F_{50}$) was taken as an indication of stress crack resistance.

(2) Abrasion Resistance

A Taber abrasion test as defined by JIS K 7204 was carried out under the following conditions to measure abrasion wear.

Test Conditions

Load: 1 kg

Truck wheel: CS-17

Rotational speed of truck wheel: 60 rpm

Rotational number of truck wheel: 1000 times (3) Low-temperature Impact Resistance An Izod impact test was carried out at −40° C. in accordance with ASTM D 256 to measure Izod impact strength (notched).

The polyethylene resins used in the examples and the comparative examples are as follows.

Polyethylene Resin Prepared Using Metallocene Catalyst (A-1) Ethylene/1-hexene Copolymer Ethylene content: 89.7% by weight Density (ASTM D 1505): 0.920 g/cm$^3$ MFR (ASTM D 1238, 190° C., load of 2.16 kg): 4 g/10 min n-Decane-soluble component fraction (W) at room temperature: 0.5% by-weight Flow index (FI): 320 (1/sec)

Amount of component eluted at 100° C. or higher in temperature rise elution test: 3.2% by weight (A-2) Ethylene/1-hexene Copolymer Ethylene content: 83.9% by weight Density (ASTM D 1505): 0.905 g/cm$^3$ MFR (ASTM D 1238, 190° C., load of 2.16 kg): 0.5 g/10 min n-Decane-soluble component fraction (W) at room temperature: 1.8% by weight Flow index (FI): 40 (1/sec)

Amount of component eluted at 100° C. or higher in temperature rise elution test: 2.3% by weight (A-3) Ethylene/1-hexene Copolymer Ethylene content: 94.9% by weight Density (ASTM D 1505): 0.945 g/cm$^3$ MFR (ASTM D 1238, 190° C., load of 2.16 kg): 60 g/10 min n-Decane-soluble component fraction (W) at room temperature: 0.35% by weight Flow index (FI): 4700 (1/sec)

Amount of component eluted at 100° C. or higher in temperature rise elution test: 5.2% by weight

High-pressure Low-density Polyethylene (B-1) High-pressure Low-density Polyethylene Density (ASTM D 1505): 0.922 g/cm$^3$ MFR (ASTM D 1238, 190° C., load of 2.16 kg): 0.6 g/10 min n-Decane-soluble component fraction (W) at room temperature: 0.4% by weight (B-2) High-pressure Low-density Polyethylene Density (ASTM D 1505): 0.918 g/cm$^3$ MFR (ASTM D 1238, 190° C., load of 2.16 kg): 2.9 g/10 min n-Decane-soluble component fraction (W) at room temperature: 0.5% by weight

Linear Low-density Polyethylene Prepared by Using Ziegler Catalyst (C-1) Ethylene/1-butene Copolymer Ethylene content: 90.1% by weight Density (ASTM D 1505): 0.920 g/cm$^3$ MFR (ASTM D 1238, 190° C., load of 2.16 kg): 0.6 g/10 min n-Decane-soluble component fraction (W) at room temperature: 6.5% by weight Flow index (FI): 120 (1/sec)

Amount of component eluted at 100° C. or higher in temperature rise elution test: 11% by weight

Example 1

90 parts by weight of the metallocene type linear low-density ethylene/1-hexene copolymer (A-1), 10 parts by weight of the high-pressure low-density polyethylene (B-1) and 10 parts by weight (based on 100 parts by weight of both components) of a carbon black masterbatch (CBMB) containing as a base the high-pressure low-density polyethylene (B-1) and having a concentration of 26% by weight were blended by a Henschel mixer, and then melt kneaded by a single-screw extruder (65 mmϕ, L/D=26) under the condition of a temperature of 190° C. and a resin extrusion rate of 40 kg/hr to obtain a polyethylene resin (PE-1).

The polyethylene resin (PE-1) was sheeted under the following conditions to obtain a sheet having a thickness of 2 mm.

Machine: three-roll T-die sheeting machine equipped with extruder of 65 mm diameter Molding temperature: 200° C.

Take-off speed: 15 m/min

Chill roll temperature: 35° C.

The results are set forth in Table 1.

Further, a sheathed communication cable and a sheathed wire were prepared in the same manner as in Example 1. As a result, they were each obtained in a satisfactory state.

Comparative Examples 1–3

A sheet having a thickness of 2 mm was prepared in the same manner as in Example 1, except that the resins shown in Table 1 were blended in the blending ratio shown in Table 1. The sheet underwent tests of stress crack resistance, abrasion resistance and low-temperature impact resistance by the aforesaid methods.

The results are set forth in Table 1.

TABLE 1

| | Example 1 | Example 2 | Example 3 | Example 4 | Example 5 | Example 6 | Compar. Ex. 1 | Compar. Ex. 2 | Compar. Ex. 3 |
|---|---|---|---|---|---|---|---|---|---|
| Components of polyethylene resin (parts by weight) | | | | | | | | | |
| Methallocene type polyethylene (A-1) | 90 | 80 | 60 | — | — | 80 | — | — | — |
| Methallocene type polyethylene (A-2) | — | — | — | 80 | 40 | — | — | — | — |
| Methallocene type polyethylene (A-3) | — | — | — | — | 40 | — | — | — | — |
| High-pressure low-density polyethylene (B-1) | 10 | 20 | 40 | 20 | 20 | — | — | 100 | 20 |
| High-pressure low-density polyethylene (B-2) | — | — | — | — | — | 20 | — | — | — |
| Ziegler type L-LDPE (C-1) | — | — | — | — | — | — | 100 | — | 80 |
| Carbon black masterbatch | 10 | 10 | 10 | 10 | 10 | 10 | 10 | 10 | 10 |
| Polyethylene resin composition | | | | | | | | | |
| MFR (g/10 min) | 3.4 | 2.8 | 1.8 | 0.7 | 3.6 | 4.0 | 0.6 | 0.6 | 0.6 |
| Density (g/cm$^3$) | 0.930 | 0.930 | 0.929 | 0.920 | 0.934 | 0.928 | 0.929 | 0.932 | 0.930 |
| Room temperature n-decane-soluble component fraction (% by weight) | 0.4 | 0.5 | 0.5 | 0.5 | 0.7 | 0.5 | 6.4 | 0.5 | 5.5 |
| Stress crack resistance 50% crack occurrence time (hr) | >1000 | >1000 | >1000 | >1000 | >1000 | >1000 | >1000 | 45 | 850 |
| Abrasion resistance Abrasion wear (mg) | 4.7 | 5.1 | 7.2 | 6.3 | 4.8 | 5.7 | 11 | 27 | 15 |
| Impact resistance Izod impact strength (J/m$^2$) (notched; −40° C.) | 81 | 70 | 68 | 72 | 63 | 65 | 28 | 27 | 28 |

The polyethylene resin sheet thus obtained underwent tests of stress crack resistance, abrasion resistance and low-temperature impact resistance by the aforesaid methods.

The results are set forth in Table 1.

Further, a communication cable having a diameter of 30 mm was coated with the polyethylene resin (PE-1) in a thickness of 2 mm using a cable sheathing machine under the following conditions. As a result, a satisfactory sheathed communication cable was obtained.

Machine: crosshead type sheathing machine equipped with extruder of 65 mm diameter Molding temperature: 200° C.

Take-off speed: 20 m/min

Cooling water temperature: 20° C.

Examples 2–6

A sheet having a thickness of 2 mm was prepared in the same manner as in Example 1, except that the resins shown in Table 1 were blended in the blending ratio shown in Table 1. The sheet underwent tests of stress crack resistance, abrasion resistance and low-temperature impact resistance by the aforesaid methods.

What is claimed is:

1. A sheathed wire or cable obtained by coating an outermost layer of a wire or cable with a polyethylene resin (A) prepared from the copolymer produced by polymerization using a single-site catalyst, wherein high-pressure low density polyethylene (B) having a melt flow rate (MFR, ASTM D 1238, 190° C., load: 2.16 kg) of 0.05 to 20 g/10 min, is contained in the polyethylene resin (A) in an amount of not more than 50% by weight.

2. The sheathed wire or cable as claimed in claim 1, wherein the polyethylene resin (A) is a copolymer of ethylene and an α-olefin of 3 to 20 carbon atoms and has the following properties:

(1) the density (d) is in the range of 0.880 to 0.950 g/cm$^3$, and (2) the melt flow rate (MFR, ASTM D 1238, 190° C., load: 2.16 kg) is in the range of 0.01 to 20 g/10 min.

3. The sheathed wire or cable as claimed in claim 1 or 2, wherein the polyethylene resin (A) has the following properties:

the n-decane-soluble component fraction (W (% by weight)) at room temperature and the density (d (g/cm$^3$)) satisfy the following relation in case of MFR≦10 g/10 min:

$$W<80\times\exp(-100(d-0.88))+0.1,$$

in case of MFR>10 g/10 min:

$$W<80\times(\mathrm{MFR}-9)^{0.35}\times\exp(-100(d-0.88))+0.1.$$

4. The sheathed wire or cable as claimed in claim 3, wherein the polyethylene resin (A) has the following properties:

the flow index (FI (1/sec)), which is defined as a shear rate at which the shear stress of the polymer in a molten state at 190° C. reaches $2.4\times10^6$ dyne/cm$^2$, and the melt flow rate (MFR (g/10 min)) satisfy the following relation

FI>75×MFR.

5. The sheathed wire or cable as claimed in claim 4, wherein when the polyethylene resin (A) is subjected to a temperature rise elution test (TREF), a component that is eluted at a temperature of not lower than 100° C. is present in the resin and the amount of said component is not more than 10% of the whole elution amount.

6. The sheathed wire or cable as claimed in claims 1 to 2, wherein the polyethylene resin (A) has the following properties:

(i) the 50% crack occurrence time ($F_{50}$, ASTM D 1698) that becomes an indication of stress crack resistance is not less than 600 hours, (ii) the abrasion wear as measured by a Taber abrasion test (JIS K 7204, load: 1 kg, truck wheel: CS-17, 60 rpm, 1000 times) is not more than 10 mg, and (iii) the Izod impact strength (ASTM D 256, notched) as measured at −40° C. is not less than 40 J/m$^2$.

7. The sheathed wire or cable of claim 1 wherein the high-pressure low density polyethylene (B) is obtained in the presence of a radical polymerization catalyst.

8. The sheathed wire or cable of claim 1 wherein the high-pressure low density polyethylene (B) is obtained by copolymerizing ethylene and a vinyl monomer.

9. The sheathed wire or cable of claim 1 wherein the high-pressure low density polyethylene (B) has a melt flow rate (MFR, ASTM D 1238, 190° C., load: 2.16 kg) of 0.1 to 10 g/10 min.

10. The sheathed wire or cable of claim 1 which is formed by extrusion coating.

* * * * *